US010488810B2

(12) United States Patent
Kawanami

(10) Patent No.: US 10,488,810 B2
(45) **Date of Patent: *Nov. 26, 2019**

(54) IMAGE FORMING APPARATUS HAVING DETACHABLE TRANSFER UNIT

(71) Applicant: CANON KABUSHIKI KAISHA, Tokyo (JP)

(72) Inventor: Takeo Kawanami, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/048,602

(22) Filed: Jul. 30, 2018

(65) Prior Publication Data

US 2018/0335749 A1 Nov. 22, 2018

Related U.S. Application Data

(62) Division of application No. 15/611,013, filed on Jun. 1, 2017, now Pat. No. 10,061,263, which is a division (Continued)

(30) Foreign Application Priority Data

Apr. 21, 2014 (JP) ..... 2014-087210

(51) Int. Cl.
*G03G 21/16* (2006.01)
*G03G 21/18* (2006.01)

(52) U.S. Cl.
CPC ..... *G03G 21/1647* (2013.01); *G03G 21/168* (2013.01); *G03G 21/1623* (2013.01);

(Continued)

(58) Field of Classification Search
CPC ..... G03G 21/1623; G03G 21/1671; G03G 21/1676; G03G 21/168; G03G 21/1821;

(Continued)

(56) References Cited

U.S. PATENT DOCUMENTS 8,103,189 B2 1/2012 Maeda
8,112,014 B2 2/2012 Kawanami (Continued)

FOREIGN PATENT DOCUMENTS

JP 2002-006716 A 1/2002
JP 2002-009716 A 1/2002

(Continued)

OTHER PUBLICATIONS

European Search Report dated Oct. 28, 2015, in related European Patent Application No. 15163962.2.

(Continued)

*Primary Examiner* — Sophia S Chen
(74) *Attorney, Agent, or Firm* — Venable LLP

(57) ABSTRACT

An image forming apparatus for forming an image on a recording material includes a main assembly, an image bearing member forming a developer image, a cartridge detachably mountable to the main assembly and including a developing member configured to carry a developer to be applied to the image bearing member, and a transfer unit including an endless belt, a roller supporting the endless belt, and a roller supporting member for supporting the roller. In addition, a developing member moving mechanism moves the developing member relative to the image bearing member between a first position in which the developing member supplies the developer to the image bearing member and a second position which is different from the first position. The developing member moving mechanism is provided between the roller supporting member and the endless belt with respect to a longitudinal direction of the roller.

10 Claims, 12 Drawing Sheets

Related U.S. Application Data of application No. 15/427,232, filed on Feb. 8, 2017, now Pat. No. 9,703,254, which is a division of application No. 14/686,826, filed on Apr. 15, 2015, now Pat. No. 9,599,956.

(52) U.S. Cl.
CPC ..... *G03G 21/1676* (2013.01); *G03G 21/1821* (2013.01); *G03G 21/1671* (2013.01); *G03G 2221/1684* (2013.01)

(58) Field of Classification Search
CPC ..... G03G 21/1842; G03G 21/1853; G03G 2221/163; G03G 2221/1642; G03G 2221/1684; G03G 2221/1869; G03G 21/1647
See application file for complete search history.

(56) References Cited

U.S. PATENT DOCUMENTS

| | | | |
|---|---|---|---|
| 8,355,650 | B2 | 1/2013 | Kawanami |
| 8,565,639 | B2 | 10/2013 | Nittani et al. |
| 8,862,022 | B2 | 10/2014 | Sato et al. |
| 8,965,256 | B2 | 2/2015 | Kawanami et al. |
| 9,141,038 | B2 | 9/2015 | Maeda et al. |
| 9,335,726 | B2 | 5/2016 | Maeda et al. |
| 9,429,906 | B2 | 8/2016 | Yoshimura et al. |
| 9,494,915 | B2 | 11/2016 | Sato et al. |
| 9,599,956 | B2 | 3/2017 | Kawanami |
| 9,703,254 | B2 | 6/2017 | Kawanami |
| 2006/0140669 | A1 | 6/2006 | Sato |
| 2007/0231001 | A1 | 10/2007 | Kaiho et al. |
| 2008/0138112 | A1 | 6/2008 | Nakashima |
| 2009/0214274 | A1 | 8/2009 | Maeda |
| 2010/0310274 | A1 | 12/2010 | Matsunai |
| 2011/0164897 | A1 | 7/2011 | Kikuchi |
| 2011/0311272 | A1 | 12/2011 | Nittani et al. |
| 2012/0128387 | A1 | 5/2012 | Kim |
| 2013/0308978 | A1 | 11/2013 | Nittani et al. |
| 2014/0147167 | A1 | 5/2014 | Fukase |
| 2015/0010325 | A1 | 1/2015 | Sato et al. |
| 2015/0063834 | A1 | 3/2015 | Kobayashi et al. |
| 2015/0227110 | A1 | 8/2015 | Yoshimura et al. |
| 2017/0031313 | A1 | 2/2017 | Sato et al. |
| 2017/0269541 | A1 | 9/2017 | Kawanami |

FOREIGN PATENT DOCUMENTS

| | | | |
|---|---|---|---|
| JP | 2002-062781 | A | 2/2002 |
| JP | 2002-149032 | A | 5/2002 |
| JP | 2007-121845 | A | 5/2007 |
| JP | 2007-199660 | A | 8/2007 |
| JP | 2008-033372 | A | 2/2008 |
| JP | 2009-204656 | A | 9/2009 |
| JP | 2012-027449 | A | 2/2012 |
| JP | 2012-103485 | A | 5/2012 |
| JP | 2013-097185 | A | 5/2013 |
| JP | 2014-067005 | A | 4/2014 |
| JP | 2015-206897 | A | 11/2015 |
| KR | 10-2013-0112780 | A | 10/2013 |
| TW | 201411301 | A | 3/2014 |
| WO | 2014/038725 | A1 | 3/2014 |

OTHER PUBLICATIONS

Japanese Office Action dated Jun. 30, 2015, in related Japanese Patent Application No. 2014-087210.
Japanese Office Action dated Oct. 27, 2015, in related Japanese Patent Application No. 2014-087210.
Korean Office Action dated Mar. 23, 2017, in related Korean Patent Application No. 10-2015-0055094.
Chinese Office Action dated Apr. 24, 2017, in related Chinese Patent Application No. 201510189093.1 (with English translation).
Japanese Office Action dated Jan. 9, 2018, in related Japanese Patent Application No. 2016-018737.
Korean Decision to Refuse dated Oct. 20, 2017, in related Korean Patent Application No. 9-5-2017-072848520.
Korean Notice of Allowance dated Jan. 22, 2018, in related Korean Patent Application No. 9-5-2018-005185037.
Japanese Office Action dated Feb. 12, 2019, in related Japanese Patent Application No. 2018-080480.

IMAGE FORMING APPARATUS HAVING DETACHABLE TRANSFER UNIT

This application is a divisional of application Ser. No. 15/611,013, filed Jun. 1, 2017, which is a divisional of application Ser. No. 15/427,232, filed Feb. 8, 2017, now U.S. Pat. No. 9,703,254, issued Jul. 11, 2017, which is a divisional of application Ser. No. 14/686,826, filed Apr. 15, 2015, now U.S. Pat. No. 9,599,956, issued Mar. 21, 2017.

FIELD OF THE INVENTION AND RELATED ART

The present invention relates to an image forming apparatus, such as a copying machine, a multi-function machine or a laser beam printer, using an electrophotographic type or an electrostatic recording type.

As described in Japanese Laid-Open Patent Application (JP-A) 2012-027449, there is a conventional constitution in which when an image is not formed (during non-image formation), a developing roller (developer carrying member) is spaced (separated) from a photosensitive drum (image bearing member). This constitution is employed for avoiding movement of a developer (toner) from the developing roller to the photosensitive drum during the non-image formation and deformation of the developing roller due to contact between the developing roller and the photosensitive drum for a long time.

In the constitution described above, a developing device (developing roller) contact-and-separation mechanism for switching a state in which the developing roller and the photosensitive drum approach each other and a state in which the developing roller and the photosensitive drum are spaced from each other is provided in the image forming apparatus.

In the image forming apparatus in which the photosensitive drum contact-and-separation mechanism is provided, there is possibility that the image forming apparatus is upsized since the developing device contact-and-separation mechanism is provided.

Therefore, the image forming apparatus in which the developing device contact-and-separation mechanism is provided has been required to be downsized.

SUMMARY OF THE INVENTION

According to an aspect of the present invention, there is provided an image forming apparatus for forming an image on a recording material, comprising: a main assembly to which a cartridge including an image bearing member on which a latent image is formed and including a developing device for developing the latent image on the image bearing member is detachably mountable; and a transfer unit, detachably mountable to the main assembly separately from the cartridge, for transferring a developer image formed on the image bearing member, wherein the developing device includes a developer carrying member and is movable between a contact position where the developer carrying member is contacted to the image bearing member and a spaced position where the developer carrying member is spaced from the image bearing member, and wherein the transfer unit includes a developing device contact-and-separation mechanism for moving the developing device between the contact position and the spaced position.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiment 1

Figure 3:
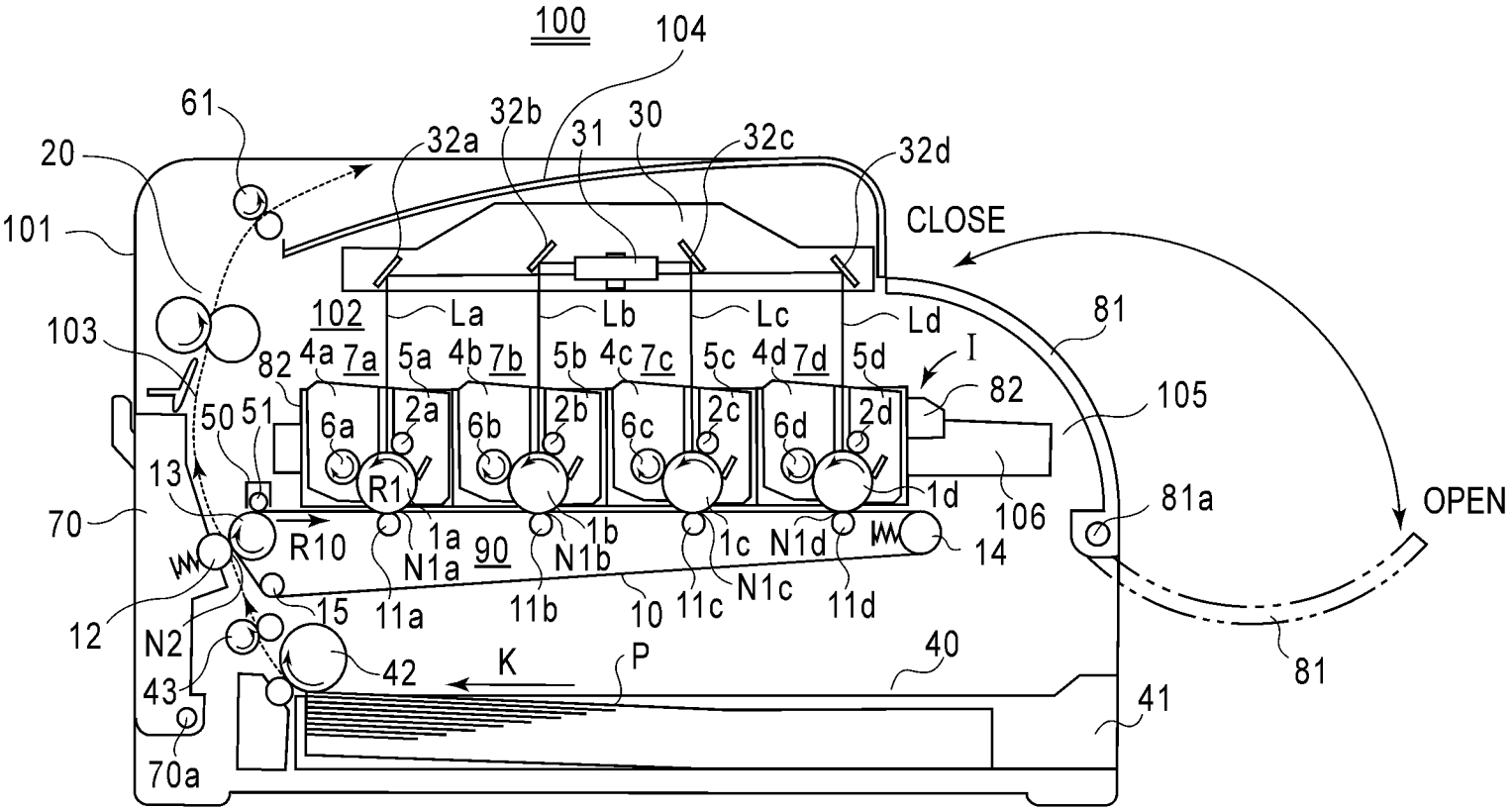
FIG. 3 is a longitudinal left side view showing a schematic structure of the image forming apparatus in a state in which an image forming operation is capable of being performed.

FIG. 3 is a longitudinal left side view showing a schematic structure of an image forming apparatus 100 in this embodiment. This image forming apparatus 100 is a four-color basis color laser beam printer of an electrophotographic type and of a tandem type.

With respect to the image forming apparatus 100, a front (surface) side is a side where a front door 81 is provided. A rear (surface) side is a side opposite from the front side. Left and right are those of the image forming apparatus 100 as seen from the front side. Up (upper) and Low (lower) are those of the image forming apparatus 100 with respect to a direction of gravitation.

(Image Forming Mechanism Portion)

The image forming apparatus 100 includes an image forming portion 102, inside an image forming apparatus main assembly 101, for forming an unfixed toner image (unfixed image) on a fed recording material (transfer receiving material or sheet) P. The apparatus main assembly 101 is an image forming apparatus portion from which process cartridges 7*a*-7*d* described later are removed. In the apparatus main assembly 100, a plurality of the process cartridges 7 (7*a*-7*d*) are mounted.

The image forming portion 102 includes drum-type electrophotographic photosensitive members (hereinafter referred to as drums) 1*a*-1*d*, as a first image bearing member, for colors of yellow (Y), magenta (M), cyan (C) and black (Bk), respectively. Each drum 1 is rotatably supported and is rotationally driven by a driving means (not shown) at a predetermined peripheral speed in an arrow R1 (counter-clockwise) direction. At a periphery of each drum 1, along a rotational direction of the drum, as process devices actable on the drum 1, a charging roller 2 (2*a*-2*d*), a developing device 4 (4*a*-4*d*) and a cleaning device 5 (5*a*-5*d*) are provided substantially in the listed order.

The drum 1 is constituted by providing a photoconductive layer of an OPC (organic photoconductor) on an outer peripheral surface of an aluminum cylinder. The charging roller 2 is a charging device of a contact type in which the drum surface is electrically charged uniformly, and is constituted by a core metal and an electroconductive elastic member surrounding a peripheral surface of the core metal. The charging roller 2 is disposed in contact with the surface of the drum 1, and is rotated while following rotation of the drum 1 and is supplied with a charging bias (voltage) by a power source (not shown).

The developing device 4 includes a developing roller 6 (6*a*-6*d*) as a developer carrying member for carrying a toner for being supplied to the drum 1. The developing device 4 is a device for developing an electrostatic latent image, formed on the drum 1, by depositing the toner (developer) on the electrostatic latent image which brings the developing roller 6 into contact with the drum 1. The cleaning device 5 is a device for removing a primary transfer residual toner on the drum surface. The drum 1 is an image bearing member for bearing the image (latent image toner image) on its surface.

The image forming portion 102 includes an exposure device 30, a transfer unit 90 including an intermediary transfer belt (intermediary transfer member) 10 as a second image bearing member, a secondary transfer roller 12, and the like. The exposure device 30 includes, a laser oscillator (not shown) for emitting laser light depending on image information, a polygon mirror 31, mirrors 32*a*-32*d*, and the like. Further, charged surfaces of the drums 1*a*-1*d* are irradiated with (exposed to) laser lights La-Ld, respectively, depending on image information, so that the electrostatic latent images are formed.

In the transfer unit 90, the intermediary transfer belt 10 is an endless belt having flexibility and is extended around a driving roller 13, a tension roller 14 and an auxiliary roller 15 which are three supporting rollers disposed in parallel to each other. The driving roller 13 and the auxiliary roller 15 are provided in a rear side in the apparatus main assembly 101, and the tension roller 14 is provided in a front side in the apparatus main assembly 101.

The belt 10 is driven (traveled) at a peripheral speed corresponding to the rotational peripheral speed of the drums 1 in an arrow R10 (clockwise) direction by rotating the driving roller 13 by a driving means (not shown). The tension roller 14 is rotated by the travel of the belt 10, and applies a tension to the belt 10. Inside the belt 10, primary transfer rollers 11*a*-11*d* are provided correspondingly to the drums 1*a*-1*d*, respectively, and press the belt 10 against the surfaces of the drums 1*a*-1*d*, so that primary transfer nips N1*a*-N1*d* are formed between the belt 10 and the drums 1*a*-1*d*, respectively.

To each of the primary transfer rollers 11*a*-11*d*, a primary transfer bias (voltage) is applied by a power source (not shown). As a result, the transfer unit 90 transfers the toner image from the drum 1 onto the belt 10.

A secondary transfer roller 12 is provided in press-contact with the belt 10 toward the driving roller 13 at a belt contact portion of the driving roller 13. A nip between the belt 10 and the secondary transfer roller 12 is a secondary transfer portion N2. To the secondary transfer roller 12, a secondary transfer bias (voltage) is applied by a power source (not shown). Further, at the belt contact portion of the driving roller 13, in a downstream side of the secondary transfer nip N2 with respect to a belt movement direction, a belt cleaning device 50 including a cleaning roller (roller charger) 51 is provided opposed to the outer peripheral surface of the belt 10.

Below the transfer unit 90, a recording material feeding device 40 for feeding the recording material P to the secondary transfer nip N2 is provided. The device 40 includes a cassette 41 accommodating plurality of sheets of the recording material P, a feeding roller 42, a registration roller 43, and the like. The feeding roller 42 and the registration roller 43 are provided in the rear side in the apparatus main assembly 101.

The recording material P accommodated in the cassette 41 is separated and fed one by one toward the rear side in the apparatus main assembly 101 in an arrow K direction at predetermined control timing by the feeding roller 42, and then is fed from below toward above in a vertical feeding path 103 provided in the rear side in the apparatus main assembly 101. In the vertical feeding path 103, from below toward above, the feeding roller 42, the registration roller 43, the secondary transfer nip N2, a fixing device 20 and a discharging roller 61 are disposed sequentially.

The image forming portion 102 performs an image forming operation, so that the toner images of Y color, M color, C color and Bk color formed on the drums 1*a*-1*d*, respectively, are successively transferred superposedly onto the surface of the belt 10 at the primary transfer nips N1*a*-N1*d* of the drums 1*a*-1*d*, respectively. As a result, the (unfixed) toner images for a four-color basis full-color image are formed on the belt 10. Then, the toner images are secondary-transferred collectively onto the recording material P, and fed to the secondary transfer nip N2, at the secondary transfer nip N2. Image forming principle and operation of the above-described image forming portion 102 are well known and therefore will be omitted from detailed description.

The recording material P coming out of the secondary transfer nip N2 is introduced into the fixing device 20, in which the toner images are fixed under application of heat and pressure, so that the recording material P is discharged, as a full-color image-formed product, by the discharging roller 61 onto a stacking tray 104 provided in an upper surface side of the apparatus main assembly 101.

On the other hand, a secondary transfer residual toner which is not transferred onto the recording material P exists on the belt 10 after the toner image transfer onto the recording material P. This residual toner is charged by the intermediary transfer belt cleaning device 50, and then is the drum cleaning devices 5*a*-5*d* via the drums 1*a*-1*d*, respectively. That is, the residual toner is supplied with opposite-polarity electric charges, i.e., positive electric charges by the cleaning device 50, whereby the residual toner is transferred back onto the drums 1*a*-1*d* via the primary transfer nips N1*a*-N1*d*. The secondary transfer residual toner transferred back on the drums 1*a*-1*d* is removed together with the primary transfer residual toner on the drums 1*a*-1*d* by the cleaning device 5*a*-5*d*.

In the image forming apparatus 100 in this embodiment, the drum 1*a*, the charging roller 2*a*, the developing device 4*a* and the cleaning device 5*a* in the Y color image forming portion are assembled into the process cartridge 7*a* detachably mountable to the apparatus main assembly 101. Similarly, a set of the members 1*b*, 2*b*, 4*b* and 5*b* in the M color toner image forming portion, a set of the members 1*c*, 2*c*, 4*c* and 5*c* in the C color toner image forming portion and a set of the members 1*d*, 2*d*, 4*d* and 5*d* in the Bk toner image forming portion are assembled into the process cartridges 7*b*, 7*c* and 7*d*, respectively.

The process cartridge 7 includes the drum 1 as the first image bearing member and at least the developing device 4 as the process means actable on the drum 1, and has a cartridge structure including these members which are collectively and detachably mountable to a predetermined mounting portion of the apparatus main assembly 101.

(Exchanging Method of Process Cartridge)

In each of the process cartridges 7*a*-7*d*, the developer accommodated in the photosensitive drum 4 is consumed with use for image formation and a remaining amount thereof gradually decreases. Therefore, a means (not shown) for detecting a remaining developer amount of the individual cartridge 7 is provided, and lifetime pre-warning or lifetime warning is displayed depending on a detected remaining amount value by a controller (not shown). As a result, an operator is prompted to prepare a cartridge for exchange or to exchange the cartridge to be exchanged.

In the image forming apparatus in this embodiment, exchange of each of the cartridges 7*a*-7*d* is made by a pulling-out method in which the cartridge 7 is placed on a cartridge tray 82 and then is exchanged in a front access manner in order to improve usability.

The tray 82 is a long frame member extending in a front-rear direction, and the four cartridges 7*a*-7*d* are arranged in the front-rear direction and are supported. In a state in which the image forming apparatus 100 is capable of performing the image forming operation (FIG. 3), the tray 82 is in a predetermined pushed-in position (inner position) I inside the apparatus main assembly 101.

Then, the cartridges 7*a*-7*d* supported by the tray 82 are, as described later, developed and fixed in such a manner that portions-to-be-positioned 1Aa-1Ad (FIG. 5) are urged against positioning portions 91Ba-91Bd of the apparatus main assembly 101 by an urging mechanism (not shown). As a result, each of the cartridges 7*a*-7*d* is positioned relative to the apparatus main assembly 101 in a predetermined mounting position where the image forming position can be performed, and is maintained in a mounted state.

Further, the cartridge 7 is positioned by the positioning portion 91B, also the drum 1 of the cartridge 7 is positioned in a position where the image forming operation can be performed. Although specifically described later, the positioning portion 91B is provided on the transfer unit 90.

Demounting of the cartridge 7 from the apparatus main assembly 101 is made in the following manner. The front door 81 of the image forming apparatus 100 is pulled open, about a lower-edge-side hinge shaft 81*a* extending in a left-right direction, as indicated by a chain double-dashed line in FIG. 3. By opening the front door 81, an opening 105 in the front side of the apparatus main assembly 101 is largely opened as shown in FIG. 4.

Further, an urging operation of the urging mechanism which urges the portions-to-be-positioned 1Aa-1Ad (FIG. 5) of the cartridges 7*a*-7*d* against the positioning portions 91Ba-91Bd is eliminated by an interrelating mechanism (not shown) interrelated with an opening position of the front door 81.

Figure 4:
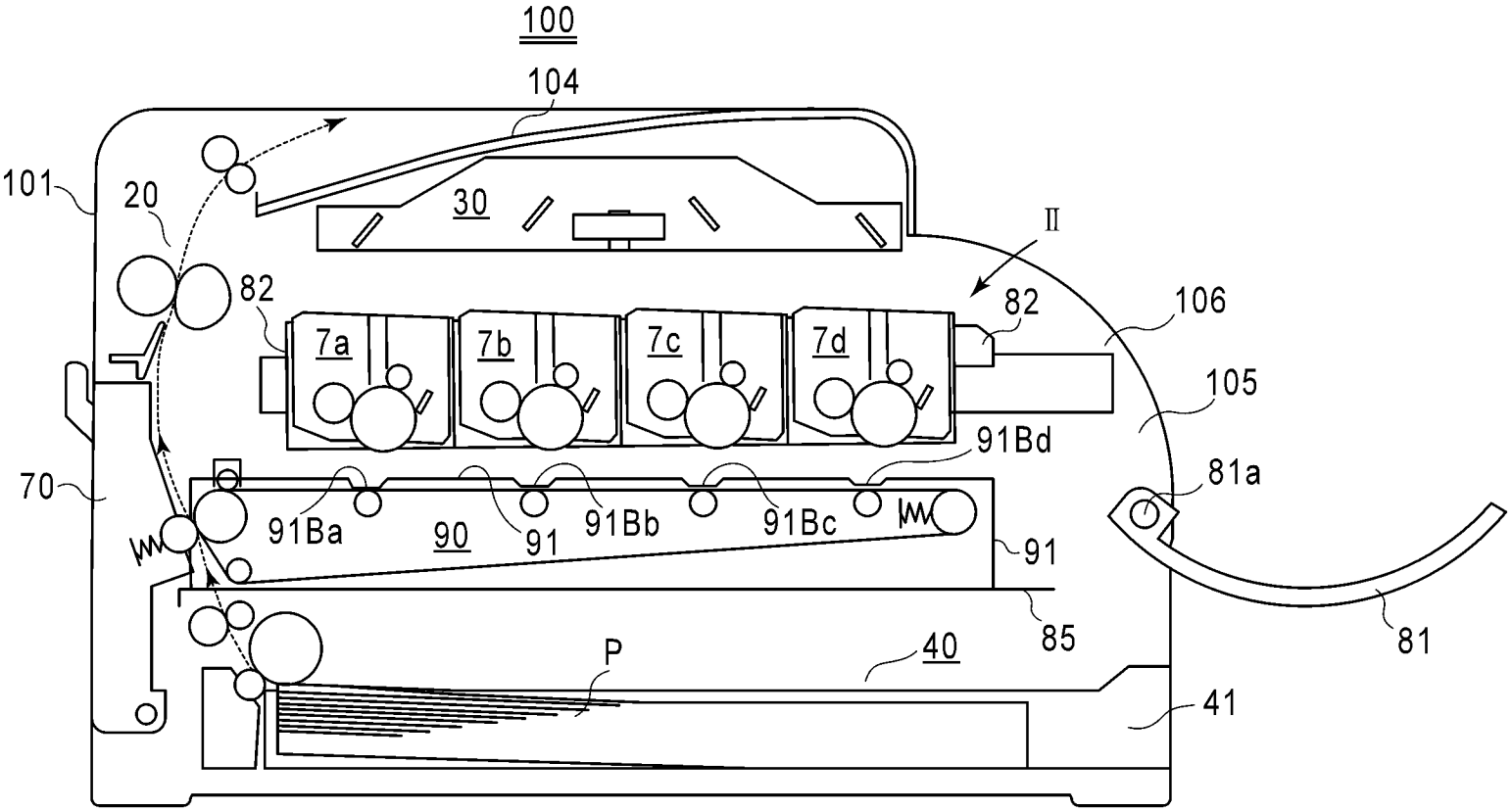
FIG. 4 is a longitudinal left side view showing a schematic structure of the image forming apparatus in a state in which a front door is open.

Further, a link mechanism (not shown) interrelated with the opening operation of the front door 81 pushes upward from the pushed-in position I of FIG. 3 to a movable position II of FIG. 4. By this pushing-up (raising) of the tray 82, the cartridges 7*a*-7*d* supported by the tray 82 are raised together with the tray 82, so that the portions-to-be-positioned 1Aa-1Ad are spaced from the positioning portion 91Ba-91Bd. As a result, engagement of the cartridge 7 with the positioning portion 91B is eliminated, so that the positioning state is removed. Further, by the raising of the tray 82, the drum 1 of the cartridge 7 is spaced from the belt 10 of the transfer unit 90.

Figure 1:
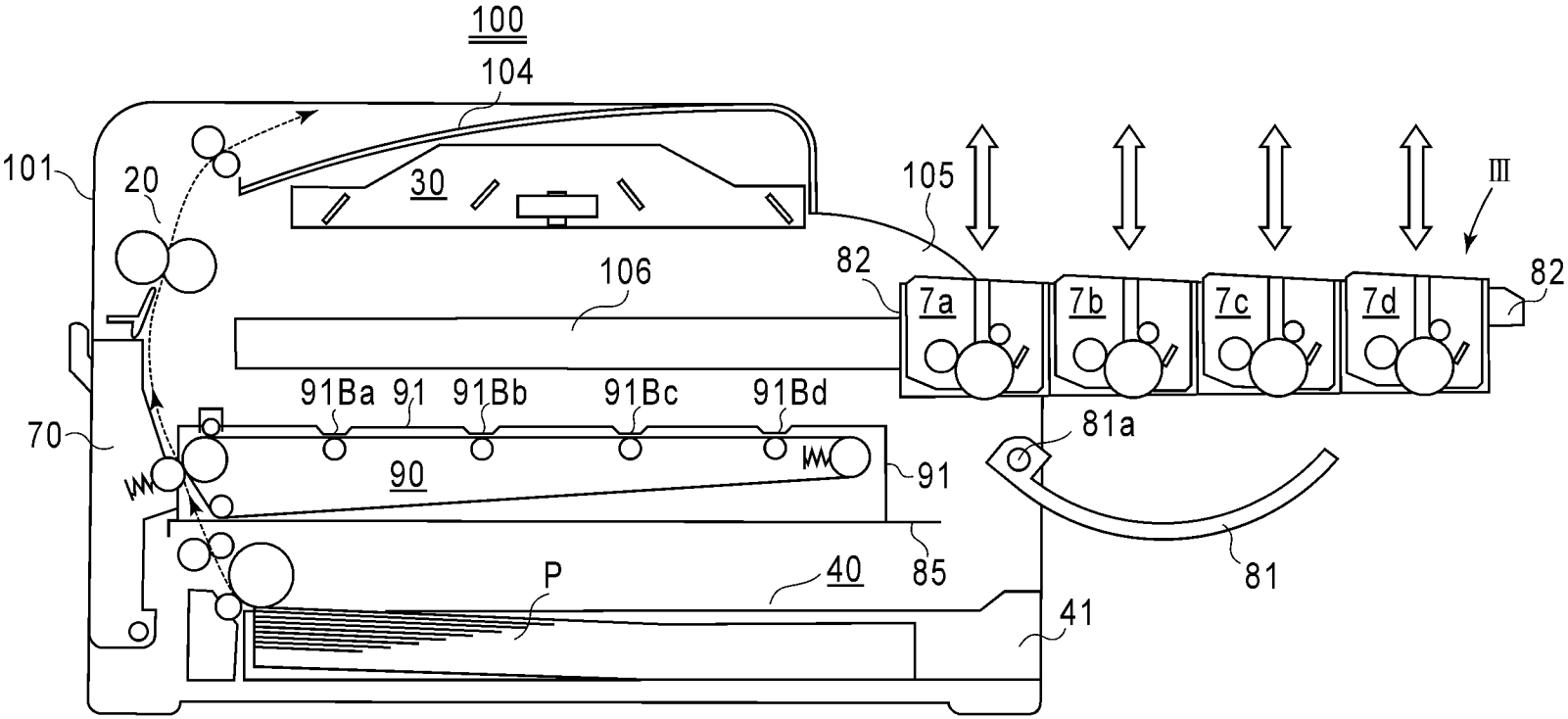
FIG. 1 is a longitudinal left side view showing a schematic structure of an image forming apparatus in Embodiment 1 in a state a cartridge tray is pulled out toward an outside of an apparatus main assembly.

The tray 82 moved to the movable position II can be pulled out by being horizontally slid and moved from this position II toward an outside of the apparatus main assembly 101 through the opening 105 along a guiding member 106 extending in the front-rear direction. Therefore, the tray 82 can be placed, as shown in FIG. 1, in a state in which the tray 82 is sufficiently pulled out, through the opening 105, to a predetermined pulled-out position (outer position) outside the apparatus main assembly 101, i.e., a mount and demounting position III where the cartridges 7*a*-7*d* can be mounted in and demounted from the tray 82 in a predetermined manner.

The tray 82 supports the individual cartridge 7 at the mounting and demounting position III so as to be demountable upward. Further, the tray 82 supports the individual cartridges 7 by limiting downward movement of the cartridges 7. Therefore, the cartridge 7 which is to be exchanged and which is used up is raised and demounted. Then, a new cartridge 7 is engaged into and placed on the tray 82 from above. That is, when the tray 82 is pulled out to the outside from the apparatus main assembly 101, the cartridges 7 can be mounted in and demounted from the apparatus main assembly 101.

Figure 5:
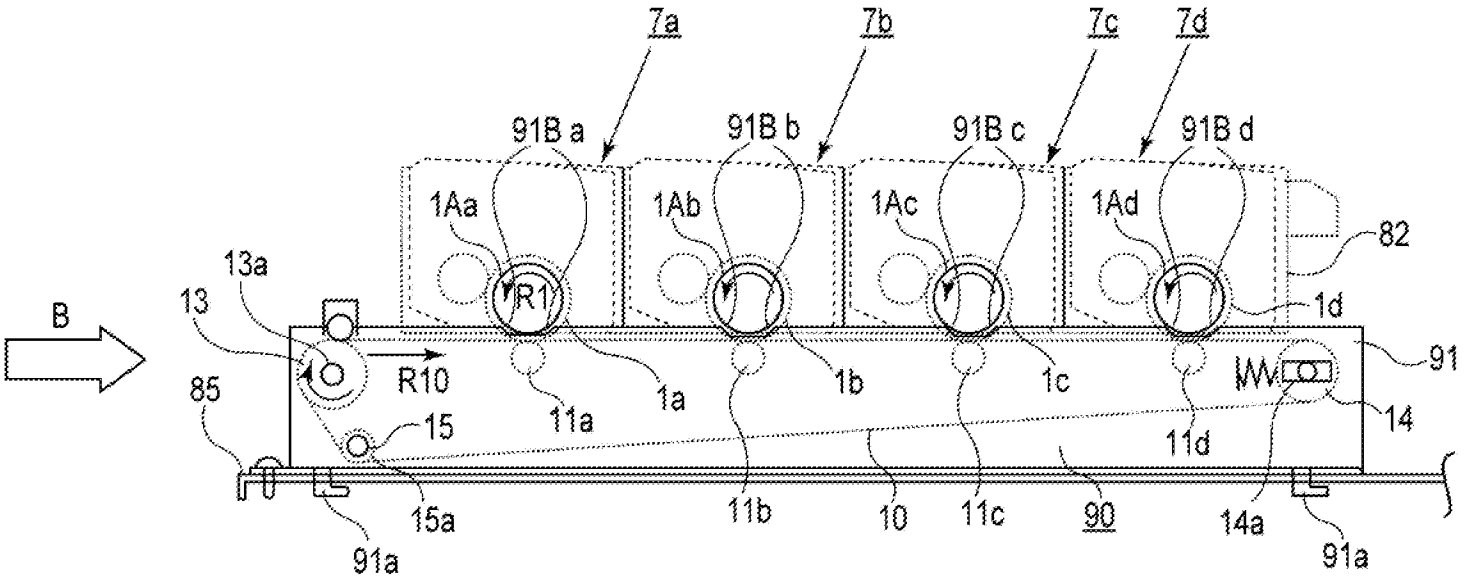
FIG. 5 is a schematic left side view showing a structure of a principal part of the image forming apparatus.

When the exchanging operation of the new and old cartridges 7 relative to the tray 82 is completed, the tray 82 is sufficiently pushed back and moved from the mounting and demounting position III to the movable position II in the apparatus main assembly 101 through the opening 105 (from FIG. 1 to FIG. 4). Then, the front portion 81 is closed, so that the opening 105 is closed (from FIG. 4 to FIG. 3). The link mechanism interrelated with the closing operation of the front door 81 moves downward (lowers) the tray 82 from the movable position II to the pushed-in position I. As a result, the portions-to-be-positioned 1Aa-1Ad of the cartridges 7*a*-7*d* supported by the tray 82 are positioned correspondingly to the positioning portions 91Ba-91Bd provided in the apparatus main assembly 101 side (FIG. 5).

Then, the urging mechanism performs the urging operation by the interrelating mechanism interrelated with the closing position of the front door 81, so that the portions-to-be-positioned 1Aa-1Ad of the cartridges 7*a*-7*d* are urged against the positioning portions 91Ba-91Bd. As a result, each of the cartridges 7*a*-7*d* is held in a state in which the cartridge 7 is mounted in the predetermined mounting position, relative to the apparatus main assembly 101, where the image forming operation can be performed, so that the image forming apparatus 100 is in a state in which the image forming apparatus can perform the image forming operation. That is when the tray 82 is lowered, the cartridge 7 is engaged with and positioned by the positioning portion 91B. Further, by the lowering of the tray 82, the drum 1 of the cartridge 7 contacts the belt 10 of the transfer unit 90.

In this way, with the raising and lowering of the tray 82 inside the apparatus main assembly 101, the positioning state of the cartridge 7 relative to the positioning portion 91B and the contact state of the drum 1 with the belt 10 change.

(Positioning Constitution of Cartridge)

Figure 6:
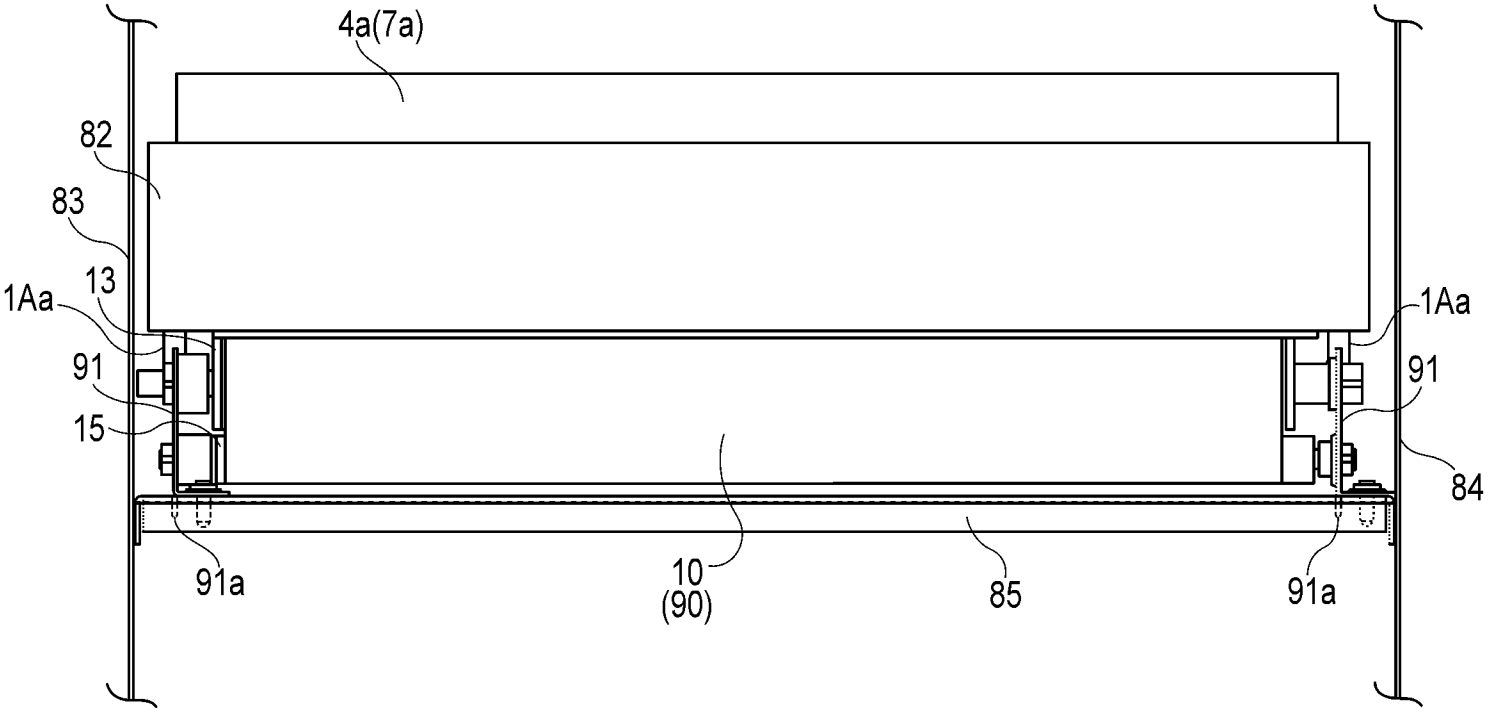
FIG. 6 is a schematic rear view showing the structure of the principal part.

The transfer unit 90 is provided with positioning members 91 for the cartridges 7*a*-7*d* in both end sides (left and right sides) of the belt 10 as shown in FIGS. 5 and 6. Further, each of the positioning members 91 are provided with the positioning portions 91Ba-91Bd corresponding to the portions-to-be-positioned 1Aa-1Ad of the four cartridges 7*a*-7*d*. In this embodiment, each of the positioning portions 91Ba-91Bd is a recessed groove shape portion (recessed portion).

Each of the positioning members 91 further includes positioning portions 13*a*, 14*a* and 15*a* for positioning the driving roller 13 for the belt 10, the tension roller 14 and the auxiliary roller 15, respectively. That is, each of the positioning members 91 is a roller supporting member for supporting the plurality of rollers (the driving roller 13, the tension roller 14 and the auxiliary roller 15) via bearings (not shown).

The positioning members 91 in both end sides have the same shape and are prepared using the same metal mold. In the case where the positioning members 91 are manufactured by a plurality of metal molds, each of the positioning members 91 in the apparatus main assembly is prepared using the same metal mold. The portions-to-be-positioned 1Aa-1Ad of the cartridges 7*a*-7*d* are bearing portions for rotatably supporting the drums 1*a*-1*d* in each of the both end sides (left and right sides). The bearing portion 1A as the portion-to-be-positioned is positioned correspondingly to the positioning portion 91B and is urged by the urging mechanism, so that the positioning and fixing of the cartridge 7 to the mounting portion of the cartridge 7 are made.

(Developing Device Contact-and-Separation Mechanism)

In each of the cartridges 7*a*-7*d* mounted in the mounting portion of the apparatus main assembly 101 in a predetermined manner, the developing device 4 is swung so that the developing roller 6 is contacted to and spaced from the drum 1 by a developing device (developing roller) contact-and-separation mechanism 189 (FIG. 9) provided in the transfer unit 90. That is, the developing device 4 has a movable constitution relative to the drum 1 and is movable between a contact position ((a) of FIG. 9) where the developing roller 6 is contacted to the drum 1 and a spaced ((b) of FIG. 9) where the developing roller 6 is spaced from the drum 1.

Figure 8:
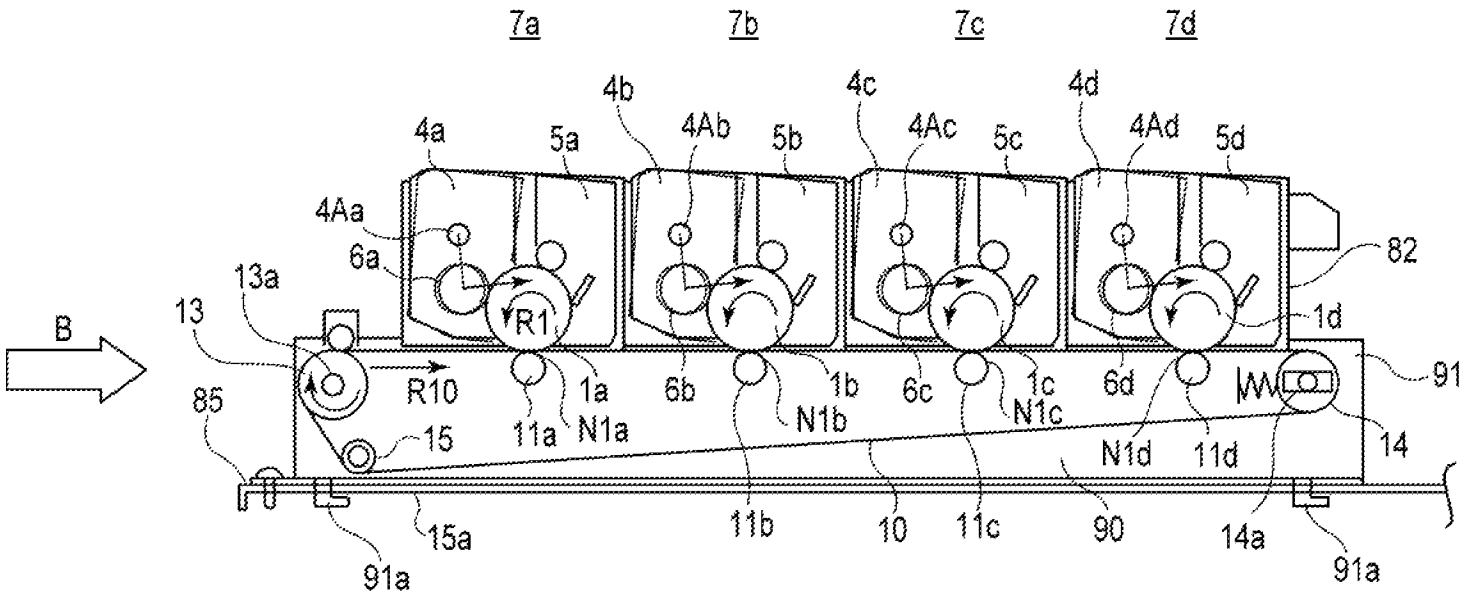
FIG. 8 is a schematic longitudinal left side view showing an inserting direction of an intermediary transfer unit and relation among respective components (parts).

That is, immediately before start of the development in the image forming operation of the image forming apparatus 100, the developing devices 4*a*-4*d* are swung relative to the drums 1*a*-1*d* in a contact direction, so that the developing rollers 6*a*-6*d* are contacted to the drums 1*a*-1*d*, respectively, as indicated by a solid line in FIG. 8. Then, after completion of the development, the developing devices 4*a*-4*d* are swung relative to the drums 1*a*-1*d* in a separation direction, so that the developing rollers 6*a*-6*d* are spaced (separated) from the drums 1*a*-1*d*, respectively, as indicated by a broken line in FIG. 8. During stand-by in which there is no job, the developing rollers 6*a*-6*d* are kept in this spaced state.

By this contact and separation operation, extension of the lifetime of the developing device 4 is realized. That is, the developing roller 6 is spaced from the drum 1, a load exerted on the developing roller 6 decreases, so that the developing roller 6 can be used for a long term. Further, when the image is not formed, it is also possible to suppress movement of the toner from the developing roller 6 to the drum 1.

The developing device contact-and-separation mechanism 189 in this embodiment will be described with reference to FIGS. 9 and 10. In each of the cartridges 7*a*-7*d*, the drum 1 is rotatably supported by the frame of the cleaning device 5. The developing device 4 is supported rotatably about a developing device pivot 4A (4Aa-4Ad) relative to the frame of the cleaning device 5. That is, the developing device 4 is supported so as to be movable toward and away from the drum 1.

Then, in a state in which the cartridge 7 is mounted at the mounting portion in the predetermined manner, the drum bearing portions 1Aa-1Ad, as the portions-to-be-positioned, of the frame of the cleaning device 5 are developed correspondingly to the positioning portions 91Ba-91Bd, respectively, provided in the apparatus main assembly 101 side (FIGS. 5 and 6). Then, the drum bearing portion 1A is urged against the positioning portion 91B by the urging mechanism, so that the cartridge 7 is positioned and fixed.

Relative to the frame of the cleaning device 5 which is positioned and fixed, the developing device 4 is swung about the pivot 4A by the developing device contact-and-separation mechanism 189, so that the state of the developing roller 6 is switched between a state in which the developing roller 6 is contacted to the drum 1 and a state in which the developing roller 6 is spaced from the drum 1. The developing device contact-and-separation mechanism 189 is, in the transfer unit 90, disposed between the positioning member 91 and the cartridges 7*a*-7*d* as shown in FIG. 10, and is a mechanism for driving the developing devices 4*a*-4*d* of the cartridges 7*a*-7*d* so as to be contacted to and spaced from the drums 1*a*-1*d*.

Figure 10:
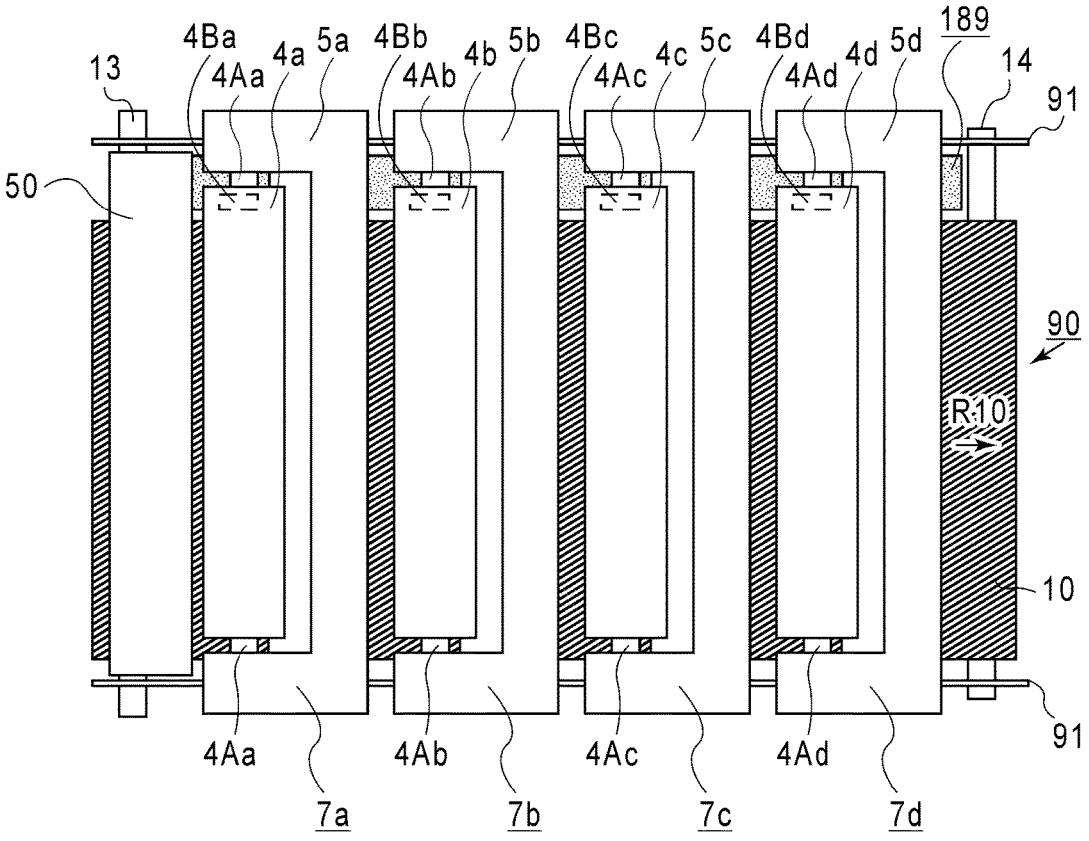
FIG. 10 is a schematic top view showing arrangement of a plurality of cartridges and the transfer unit.

As shown in FIG. 10, the developing device contact-and-separation mechanism 189 is in a position (between the belt 10 and the positioning member 91) sandwiched by the belt 10 and the positioning member 91.

Figure 9:
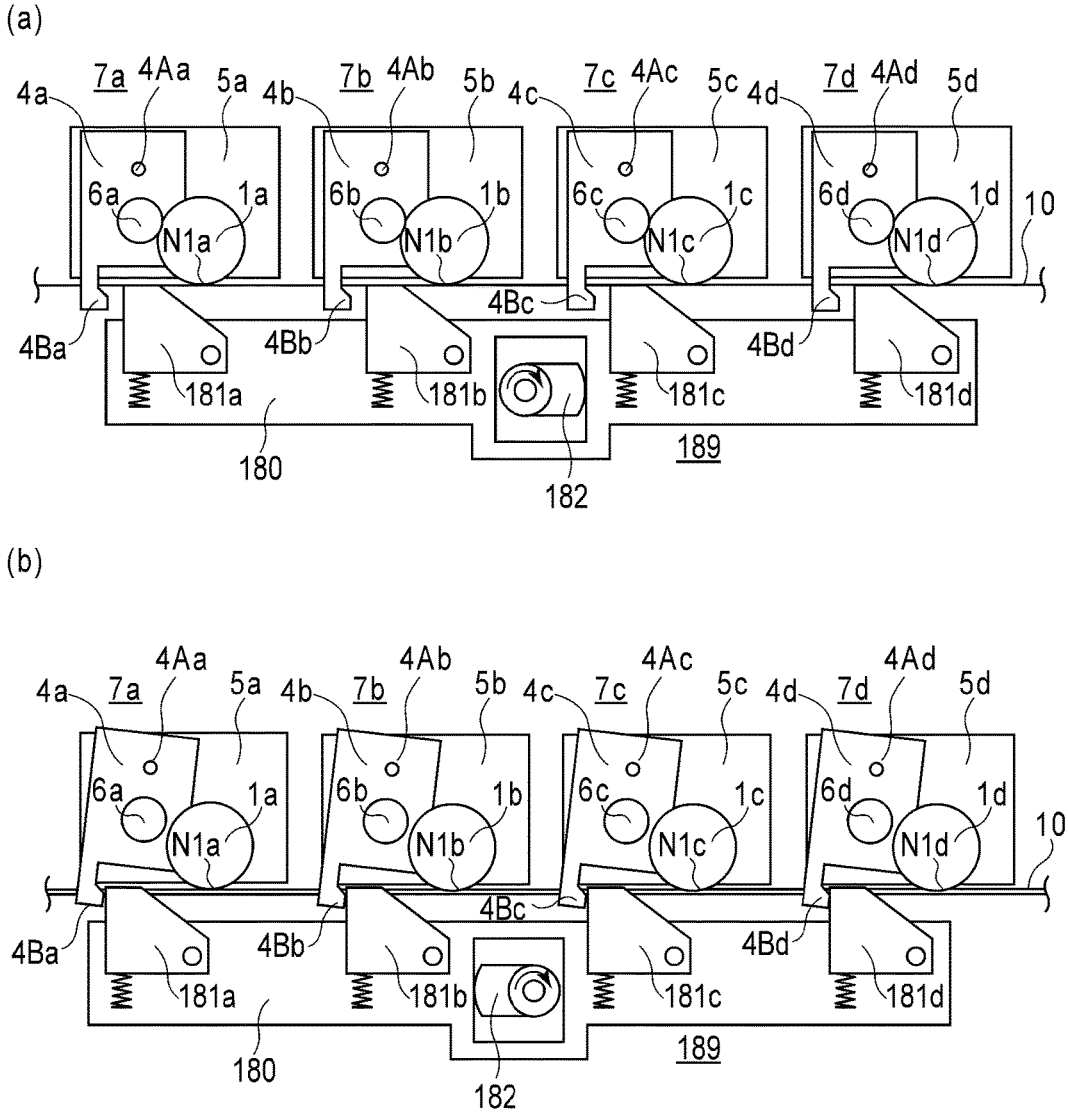
In FIG. 9, (a) and (b) are schematic illustrations of a developing device contact-and-separation mechanism.

The developing device 4 and the developing device contact-and-separation mechanism 189 are engaged so that spacing levers 4Ba-4Bd of the developing devices 4*a*-4*d* and spacing hooks 181*a*-181*d* of the developing device contact-and-separation mechanism 189 engage with each other as shown in FIG. 9. The spacing hooks 181*a*-181*d* are engaging members engageable with the developing devices 4*a*-4*d*, respectively, of the cartridges 7*a*-7*d*.

A specific developing device contact-and-separation operation will be described. The developing device contact-and-separation mechanism 189 is driven by inputting a driving force from a driving source, provided in the apparatus main assembly 101 side, into the developing device contact-and-separation mechanism 189. That is, a developing cam 182 is rotationally driven by the driving source (not shown) drive-controlled by the controller (not shown). The developing cam 182 can create a first position where the developing roller 6 of the developing device 4 is contacted to the drum 1 as shown in (a) of FIG. 9 and a second position where the developing roller 6 of the developing device 4 is spaced from the drum 1 as shown in (b) of FIG. 9. The developing cam 182 is rotationally driven, so that the first position and the second position are switched with each other.

By the developing cam 182, a contact-and-separation rod 180 is driven with respect to a linear direction. The first position ((a) of FIG. 9) of the developing device contact-and-separation mechanism 189 is a position permitting the developing device 4 to be placed in the contact position. The second position ((b) of FIG. 9) is a position where the developing device contact-and-separation mechanism 189 holds the developing device 4 in the spaced position.

The contact-and-separation rod 180 is driven with respect to a direction in which the spacing hooks 181*a*-181*d* of the contact-and-separation rod 180 are spaced from the spacing levers 4Ba-4Bd of the developing devices 4*a*-4*d*. In this case, as shown in (a) of FIG. 9, in each of the cartridges 7*a*-7*d*, the state of the developing roller 6 is switched to the state in which the developing roller 6 is contacted to the drum 1.

Further, the contact-and-separation rod 180 is driven with respect to a direction in which the spacing hooks 181*a*-181*d* are contacted to the spacing levers 4Ba-4Bd of the photosensitive drums 4*a*-4*d*. In this case, as shown in (b) of FIG. 9, in each of the cartridges 7*a*-7*d*, the state of the developing roller 6 is switched to the state in which the developing roller 6 is spaced from the drum 1. That is, in FIG. 9, an engaging portion between the developing device contact-and-separation mechanism 189 and the developing device 4 is positioned inside a region surrounded by the belt 10.

(Mounting and Demounting Constitution of Intermediary Transfer Unit)

Figure 2:
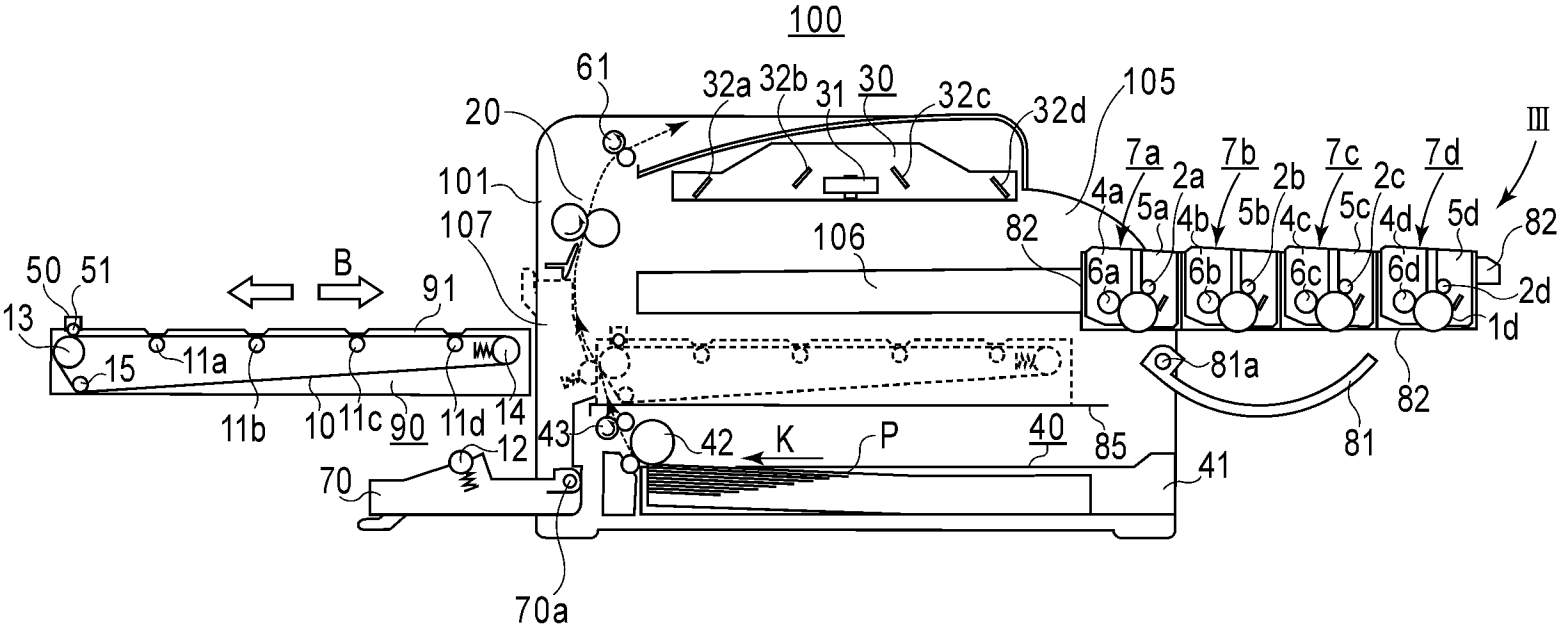
FIG. 2 is a longitudinal left side view showing a schematic structure of the image forming apparatus in a state each of the cartridge tray and a transfer unit is pulled out toward an outside of the apparatus main assembly.

Mounting and demounting of the transfer unit 90 including the belt 10 relative to the apparatus main assembly 101 and assembling of the transfer unit 90 with the apparatus main assembly 101 will be described. The mounting and demounting and the assembling of the transfer unit 90 relative to the apparatus main assembly 101 are made by opening the secondary transfer unit 70 as a rear door provided in a rear side of the apparatus main assembly 101 as shown in FIG. 2 to largely open an opening 107 in the rear side of the apparatus main assembly 101. That is, the cartridges 7*a*-7*d* and the transfer unit 90 are separately constituted so as to be detachably mountable to the apparatus main assembly 101.

In this embodiment, a state in which the transfer unit 90 is demountable from the apparatus main assembly 101 is limited to a state in which the cartridges 7*a*-7*d* are not mounted in the apparatus main assembly 101. In a state in which the cartridges 7*a*-7*d* are mounted in the apparatus main assembly 101, the spacing hook 181 (FIG. 9) of the contact-and-separation mechanism 189 engages with the cartridge 7, and therefore the demounting of the transfer unit 90 is prevented.

The secondary transfer unit 70 as the rear door includes the secondary transfer roller 12 and a recording material guiding rib constituting the vertical feeding path 103 and is opened by being rotated toward an outside of the apparatus main assembly 101 about a lower-edge-side hinge shaft 70*a* extending in a left-right direction. As a result, an opening 107 in the rear side of the apparatus main assembly 101 is largely opened. Through this opening 107, the mounting and demounting and the assembling of the transfer unit 90 relative to the apparatus main assembly 101 are made.

At that time, the tray 82 supporting the cartridges 7*a*-7*d* has been pulled out to the mounting and demounting position III after opening the front door 81. Alternatively, if all the cartridges 7*a*-7*d* are demounted from the tray 82, the tray 82 may also be accommodated inside the apparatus main assembly 101 and then the front door 81 may also be closed.

The assembling of the transfer unit 90 with the apparatus main assembly 101 is made by inserting the transfer unit 90 into the apparatus main assembly 101 in an arrow B direction (FIG. 2) through the opening 107 in the rear side of the apparatus main assembly 101. The opened secondary transfer unit 70 as the rear door is closed to the apparatus main assembly 101 to close the opening 107. After the assembling of this transfer unit 90, at the mounting and demounting position III, the cartridges 7 are supported on the tray 82 and then the tray 82 is pushed and moved toward the inside of the apparatus main assembly 101, and thereafter the front door 81 is closed.

Figure 7:
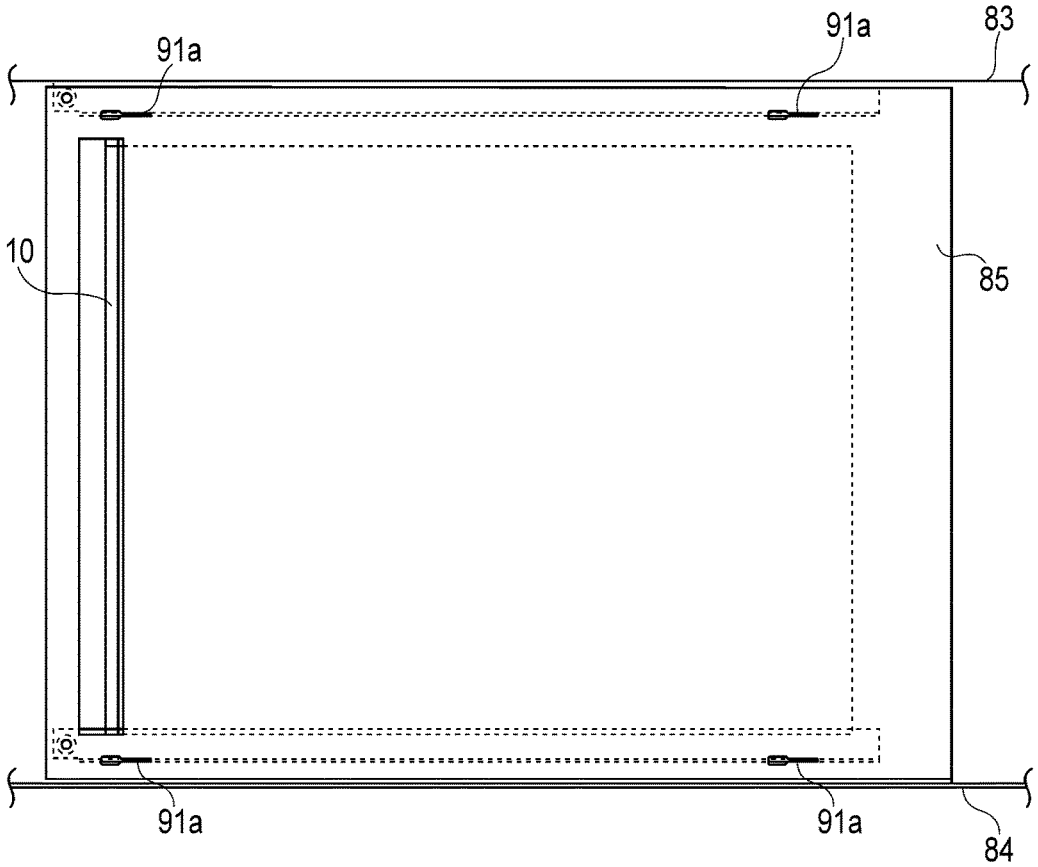
FIG. 7 is a schematic bottom view showing the structure of the principal part.

The assembling of the transfer unit 90, inserted into the apparatus main assembly 101 through the opening 107, with the apparatus main assembly 101 is made in the following manner. As shown in FIGS. 5-7, projected portions 91*a* of the positioning members 91 provided in the transfer unit 90 are inserted into and abutted against a plurality of positioning holes of a stay 85 assembled with a right side plate 83 and a left side plate 84 of the apparatus main assembly 101 with high accuracy, thus being positioned. Fixing of the transfer unit 90 is made by fastening the left and right (two) cartridge positioning members 91 and the stay 85 with screws. With respect to a direction (e.g., an arrow B direction in FIG. 5) in which the transfer unit 90 can be fixed, the transfer unit 90 may also be pressed and fixed by a pressing (not shown).

At the primary transfer nips N1*a*-N1*d*, a rotational direction (R10) of the belt 10 and an inserting direction (arrow B direction) of the transfer unit 90 are substantially the same direction. That is, when the image forming portion 102 operates, pressure is exerted in an abutment direction. As a result, in the case where the transfer unit 90 is fixed under pressure, the pressure can be lowered.

Further, a drum pressing direction (FIG. 8) of the developing roller 6 by a contact and separation operation of the developing device contact-and-separation mechanism 189 (FIGS. 9 and 10) is substantially the same direction as the inserting direction (arrow B direction) of the transfer unit 90. That is, when the image forming portion 102 operates, pressure (component pressure) is exerted in the abutment direction. As a result, in the case where the transfer unit 90 is fixed under pressure, the pressure can be lowered.

Comparison Example

Figure 11:
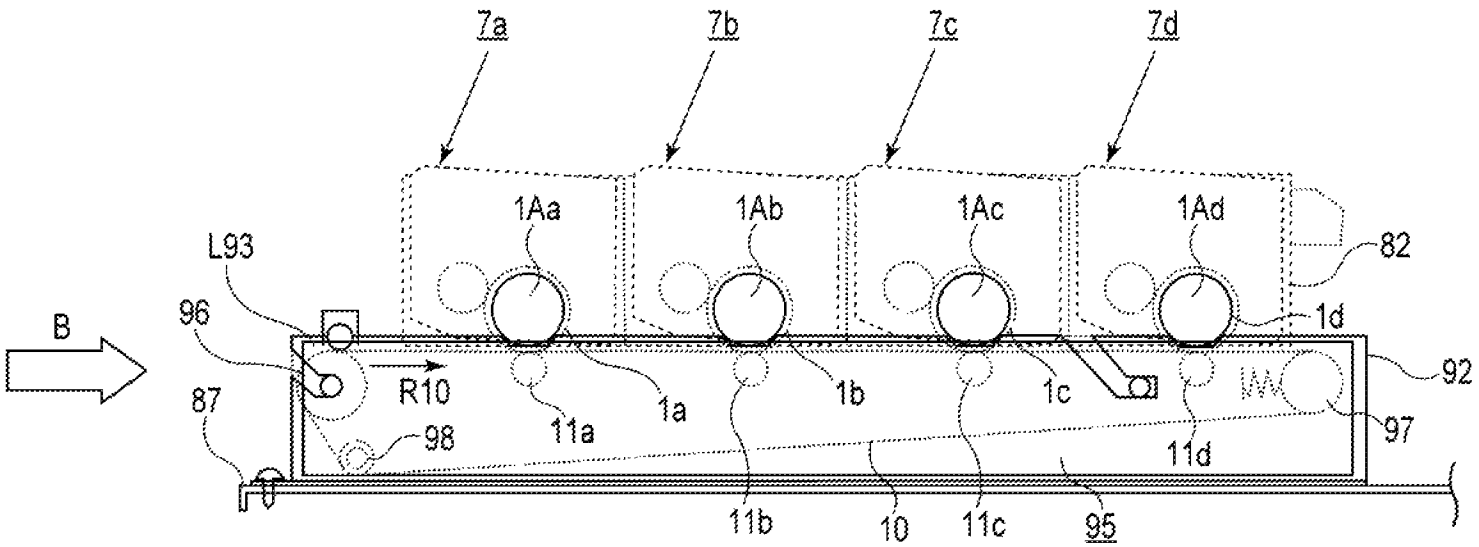
FIG. 11 is a schematic left side view showing a structure of a principal part of an image forming apparatus in a comparison example.
Figure 12:
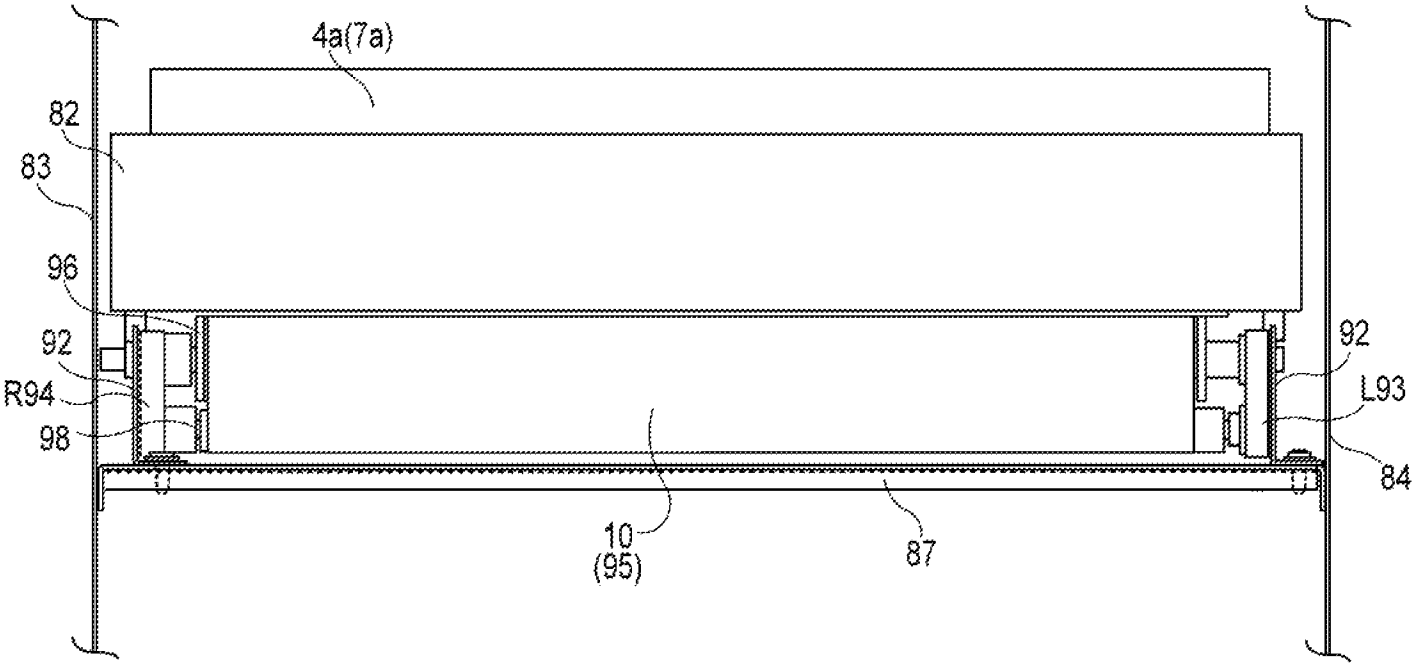
FIG. 12 is a schematic rear view showing the structure of the principal part of the image forming apparatus in the comparison example.

Positioning constitution of cartridges 7*a*-7*d* and a transfer unit 95 in a comparison example will be described briefly with reference to FIGS. 11-12. Two cartridge positioning plates 92 having the same shape are fixed with screws to a stay 87 assembled with the right side plate 83 and the left side plate 84 of the apparatus main assembly 101.

The transfer unit 95 includes an intermediary transfer frame L93 and an intermediary transfer frame R94 in both end sides of the belt 10. A driving roller 96, a tension roller 97 and an auxiliary roller 98 which stretch (support) the belt 10 are supported by the intermediary transfer frame L93 and the intermediary transfer frame R94 via bearing portions.

The exchanging method of the cartridges 7*a*-7*d* for the respective colors is similar to that in Embodiment 1 described above. Further, the mounting and demounting direction and the inserting direction of the transfer unit 95 and the methods thereof are also roughly similar to those in Embodiment 1.

In a positioning method of the transfer unit 95, positioning portions of the intermediary transfer frames L93 and R94 are abutted against the associated cartridge positioning plates 92, respectively, and thus are positioned. Fixing of the transfer unit 95 is made by fastening the intermediary transfer frames L93 and R94 to the associated cartridge positioning plates 92, respectively, with screws (not shown). Alternatively, with respect to a direction (e.g., the inserting direction) in which the transfer unit 95 can be fixed, the transfer unit 95 may also be pressed and fixed by a pressing member (not shown).

In this constitution, the intermediary transfer frames L93 and R94 are required, and therefore positioning accuracy is lowered. Further, with respect to a widthwise direction (left-right direction in FIG. 12) of the apparatus main assembly, the two parts are required, and therefore downsizing and space saving of the apparatus main assembly are impaired.

Effect of Embodiment 1

As described above, the two cartridge positioning members 91 are provided in the transfer unit 90. The intermediary transfer frames L93 and R94 as in the comparison example are not provided. Further, each of the cartridge positioning member 91 is provided with the positioning portions 91Ba-91Bd for the cartridges 7*a*-7*d* and the positioning portions 13*a*, 14*a* and 15*a* for the driving roller 13, the tension roller 14 and the auxiliary roller 15, respectively, which stretch (support) the belt 10. Further, the two cartridge positioning members 91 have the same shape.

By the above constitution, positional accuracy between the cartridges 7*a*-7*d* and the transfer unit 90 becomes high accuracy, so that it becomes possible to realize cost reduction, downsizing and space saving of the apparatus main assembly.

Further, the developing device contact-and-separation mechanism 189 is provided in the transfer unit 90, compared with the case where the developing device contact-and-separation mechanism 189 is provided outside the transfer unit 90, space saving of the apparatus main assembly 101 (downsizing of the image forming apparatus 100) can be realized.

Particularly, in this embodiment, not only the developing device contact-and-separation mechanism 189 but also the positioning members 91 for the cartridges 7 are also provided in the transfer unit 90, and therefore compared with the case where the positioning members 91 are provided outside the transfer unit 90, it is possible to realize further downsizing of the image forming apparatus 100.

In addition, the transfer unit 90 is provided with both the positioning portions 91B and the developing device contact-and-separation mechanism 189, and thus a force acting during the contact and separation of the developing device can be exerted inside the transfer unit 90, so that motion of the transfer unit 90 can be suppressed. This effect will be specifically described below.

First, in a constitution which is different from this embodiment, the developing device contact-and-separation mechanism 189 is provided outside the transfer unit 90 will be assumed. In this case, in a state the cartridges 7 are positioned in the positioning portions 91B of the transfer unit 90, the developing device contact-and-separation mechanism 189 is actuated to space the developing roller 6 from the drum 1. Then, a force is applied from the developing device contact-and-separation mechanism 189 to the transfer unit 90 via the cartridges 7. As a result, the transfer unit 90 is moved at an inside of the image forming apparatus 100, so that there is a liability that also the drum 1 moves at the inside of the apparatus main assembly 101.

In order to avoid this liability, there is a need to take such a countermeasure that a fixing portion for supporting and fixing the transfer unit 90 is upsized so that the transfer unit 90 is not moved even when a force is exerted on the transfer unit 90 from an outside (developing device contact-and-separation mechanism).

On the other hand, in this embodiment, the developing device contact-and-separation mechanism 189 is provided inside the transfer unit 90, and therefore even when the developing device contact-and-separation mechanism 189 operates and applies the force to the cartridges 7, a force is not exerted on the transfer unit 90 from the outside. For that reason, even when the state ((a) of FIG. 9) in which the developing device contact-and-separation mechanism 189 moves the developing roller 6 toward the drum 1 and the state ((b) of FIG. 9) in which the developing device contact-and-separation mechanism 189 moves the developing roller away from the drum 1 are switched from each other, the transfer unit 90 does not readily move.

Specifically, in the case where the developing roller 6 is intended to be spaced from the drum 1 by applying the force to the cartridge 7 by the spacing hook 181 ((b) of FIG. 9) of the developing device contact-and-separation mechanism 189, reaction force thereof is exerted on the transfer unit 90 via the spacing hook 181. On the other hand, the cartridge 7 to which the force is applied from the spacing hook 181 transmits the force to the transfer unit 90 via the positioning member 91. The force exerted on the transfer unit 90 via the spacing hook and the force extended on the transfer unit 90 via the positioning member 91 acts so as to cancel each other.

For that reason, the force is not readily applied to the transfer unit 90 as a whole, with the result that the transfer unit 90 does not readily move at the inside of the image forming apparatus. Further, also the drum 1 provided in the cartridge 7 positioned by the transfer unit 90 does not readily move inside the image forming apparatus 100, so that an image quality can be maintained at a high level.

Particularly, in this embodiment, the transfer unit 90 supports (positions) the plurality of the cartridges 7, and the image forming apparatus 100 forms a color image by superposing the developer images (toner images) of different colors. For that reason, there is a need to maintain positions of the drums 1 and the transfer unit 90 (belt 10) with high accuracy so as not to cause positional deviation thereof when the respective color developer images are superposed. By employing the constitution of this embodiment, suppression of movement of the transfer unit 90 and the drums 1 is effective.

Further, in this embodiment, the transfer unit 90 is demountable from the apparatus main assembly 101 of the image forming apparatus 100, and therefore has a constitution in which the transfer unit 90 readily moves relative to the image forming apparatus 100. For that reason, by employing the constitution of this embodiment, suppression of movement of the transfer unit 90 is effective.

Further, the two cartridge positioning members 91 are processed using the same metal mold, so that a relative difference between the positioning portions can be reduced. Accuracy control of the part alone and in the assembled state is also easily made.

Further, it is possible to reduce an alignment error of the driving roller 13, the tension roller 14 and the auxiliary roller 15 which stretch the belt, and therefore a laterally shifting force of the belt 10 is reduced, so that further stabilized traveling of the belt 10 becomes possible.

In addition, the transfer unit 90 is prevented from being upsized and does not become so heavy, and therefore there is no lowering in usability during mounting and demounting of the transfer unit 90 and during insertion of the transfer unit 90.

In this embodiment, the cartridge positioning members 91 are based on the premise that the metal plates are used, but if the two parts have the same, the members 91 may also be resin (molded) parts.

Further, the intermediary transfer belt 10 is used, a similar constitution can be employed also in a constitution using an electrostatic attraction belt (recording material feeding member for feeding the recording material to the image bearing member 1) for feeding the recording material P to the primary transfer nips N1*a*-N1*d* to form the image. In that case, e.g., the position of the fixing device 20 is disposed in the front side (right side in FIG. 3) of the apparatus main assembly of the exposure device 30, and the recording material P is constituted so as to be discharged from the front side to the rear side of the apparatus main assembly 101.

The image forming portion of the image forming apparatus is not limited to that of the electrophotographic type using the electrophotographic photosensitive member as the image bearing member. The image forming portion may also employ another image forming type such as an electrostatic recording type using an electrostatic recording dielectric member as the image bearing member or a magnetic recording type using a magnetic recording (magnetic) material. The image forming apparatus is not limited to the color image forming apparatus, but may also be a monochromatic image forming apparatus.

According to the constitutions described above in the present invention, the image forming apparatus including the developing device contact-and-separation mechanism can be downsized.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-087210 filed on Apr. 21, 2014, which is hereby incorporated by reference herein in its entirety.

What is claimed is:

1. An image forming apparatus for forming an image on a recording material, comprising:

a main assembly;

a cartridge detachably mountable to said main assembly;

a transfer unit including an endless belt, a roller supporting said endless belt, and a roller supporting member for supporting said roller, and configured to transfer a developer image;

a moving mechanism configured to move said cartridge, wherein said moving mechanism is provided between said roller supporting member and said endless belt with respect to a longitudinal direction of said roller, and wherein said transfer unit is configured to be detachably mountable to said main assembly.

2. An apparatus according to claim 1, wherein said cartridge includes a developing member configured to carry a developer and an image bearing member that receives the developer.

3. An apparatus according to claim 2, wherein said developing member moves relative to said image bearing member between a first position in which said developing member supplies the developer to said image bearing member and a second position which is different from the first position.

4. An apparatus according to claim 2, further comprising a second cartridge detachably mountable to said main assembly, wherein said second cartridge includes a second developing member configured to carry a developer to be applied to a second image bearing member.

5. An apparatus according to claim 4, wherein said moving mechanism includes:

a first engaging portion that is engageable with said cartridge, a second engaging portion that is engageable with said second cartridge, and a driving force transfer member able to transfer a driving force from said main assembly to said first engaging portion and said second engaging portion.

6. An apparatus according to claim 5, wherein said first engaging portion, said second engaging portion, and said driving force transfer member are positioned between said roller supporting member and said endless belt in the longitudinal direction of said roller.

7. An apparatus according to claim 6, wherein said driving force transfer member includes:

a moving portion that moves said first engaging portion and said second engaging portion, and a cam portion that drives said moving portion to move.

8. An apparatus according to claim 7, wherein said cam portion is positioned between said cartridge and said second cartridge when seen along the longitudinal direction of said roller.

9. An apparatus according to claim 5, further comprising a plurality of cartridges including said cartridge and said second cartridge, wherein said transfer unit includes a plurality of engaging portions including said first engaging portion and said second engaging portion, and said driving force transfer member transfers the driving force from said main assembly to said plurality of engaging portions.

10. An apparatus according to claim 1, wherein said moving mechanism is provided on said transfer unit.

* * * * *